US006193089B1

(12) United States Patent
Yu

(10) Patent No.: US 6,193,089 B1
(45) Date of Patent: Feb. 27, 2001

(54) CASE LOCKING ARRANGEMENT

(76) Inventor: Wen-Chung Yu, No.65, Lane 29, Huah-Cherng Rd., Shin-Jung City, Taipei County (TW)

( * ) Notice: Subject to any disclaimer, the term of this patent is extended or adjusted under 35 U.S.C. 154(b) by 0 days.

(21) Appl. No.: 09/460,399

(22) Filed: Dec. 13, 1999

(30) Foreign Application Priority Data

Jan. 22, 1999 (TW) ..... 88201105

(51) Int. Cl.[7] ..... B65D 41/16
(52) U.S. Cl. ..... 220/4.21; 220/786; 220/327
(58) Field of Search ..... 220/4.21, 4.22, 220/4.17, 782, 784, 786, 787, 788, 327

(56) References Cited

U.S. PATENT DOCUMENTS 2,930,834 * 3/1960 Hose ..... 220/4.21
4,089,464 * 5/1978 Teti, Jr. et al. ..... 220/4.01
4,466,585 * 8/1984 Maehara ..... 242/347.2
4,614,282 * 9/1986 Faul ..... 220/786
4,632,269 * 12/1986 Rose ..... 220/3.8
4,995,513 * 2/1991 Rosler ..... 206/446
5,562,223 * 10/1996 Kuroda ..... 220/4.21
5,913,650 * 6/1999 Daoud ..... 411/410
6,006,941 * 12/1999 Hitchings ..... 220/284

* cited by examiner

*Primary Examiner*—Stephen Castellano
(74) *Attorney, Agent, or Firm*—Bacon & Thomas, PLLC

(57) ABSTRACT

A case locking arrangement mainly comprising two half casings whose apertures are provided opposite to each other, wherein a flange is disposed around the aperture rim of said half casing, at prearranged position of which a number of engaging seats are provided, and wherein at least one locating post upwards extended is provided on the bottom surface of said half casing, at the end of which a screw hole is disposed, and wherein said half casing has an engaging projection and a connecting seat corresponding to said engaging seat and said locating post, and wherein the connecting seat contains a fish eye hole therein.

1 Claim, 2 Drawing Sheets

CASE LOCKING ARRANGEMENT

BACKGROUND OF THE INVENTION

1. Field of the Invention

The present invention relates to a case locking arrangement, and more particularly, to a case with an easy structure, a convenient assembly and an excellent connection strength.

2. Description of the Prior Art

The locking engagement for conventional casings generally includes a base and a cover, at whose rims an inner projection and a grooved hole are respectively provided. By means that the inner projection is engaged into the grooved hole, the base and the cover can be connected to each other. However, the connection between the base and the cover is completely dependent on the engagement of the projection into the grooved hole. In order to strengthen the connection, it's necessary to demand the respective strength of the base and the cover while the contact surface between them is also required to take into account. Consequently, in order to solve the assembly problem and inconvenience in enhancing the projection part to increase the contact surface with the grooved hole, it's important to obtain a solution for the balance between the assembly convenience and the connection strength.

In addition, the conventional grooved hole is arranged on the projected grooved seat at the rim of the base of the cover. However, the grooved seat has no arrangement to increase the strength so that it will be easily destroyed after a long period use (or due to abnormal external force).

SUMMARY OF THE INVENTION

It is a main object of the present invention to provide an improvement for the case locking arrangement, in which two half casings contain an engaging projection with an arched face and an engaging seat with strengthening ribs at the corresponding position, wherein an easy engagement and positioning of the engaging projection into the engaging seat can be easily achieved by means of the guidance of the arched face while strengthening ribs are used to enhance the strength of the engaging seat in order to form a locking arrangement with easy assembly and stable connection.

It is another object of the present invention to provide an improvement for the case locking arrangement, in which tow half casings contain a connecting seat and a locating post at the corresponding position of the other side thereof, so that a stable connection of the two half casings can be achieved by means that the locating post is connected to the connecting seat and both are screwed together, and wherein the use of the screw can be less frequently due to a direct stable connection of the locating post to the connecting seat.

It is a further object of the present invention to provide an improvement for the case locking arrangement, in which the connecting seat and the locating post completely cover the screw so that the exposition thereof can be prevented to effectively reduce the interference of the electromagnetic waves and therefore the electrical operation inside of the two half casings can be more stabilized.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
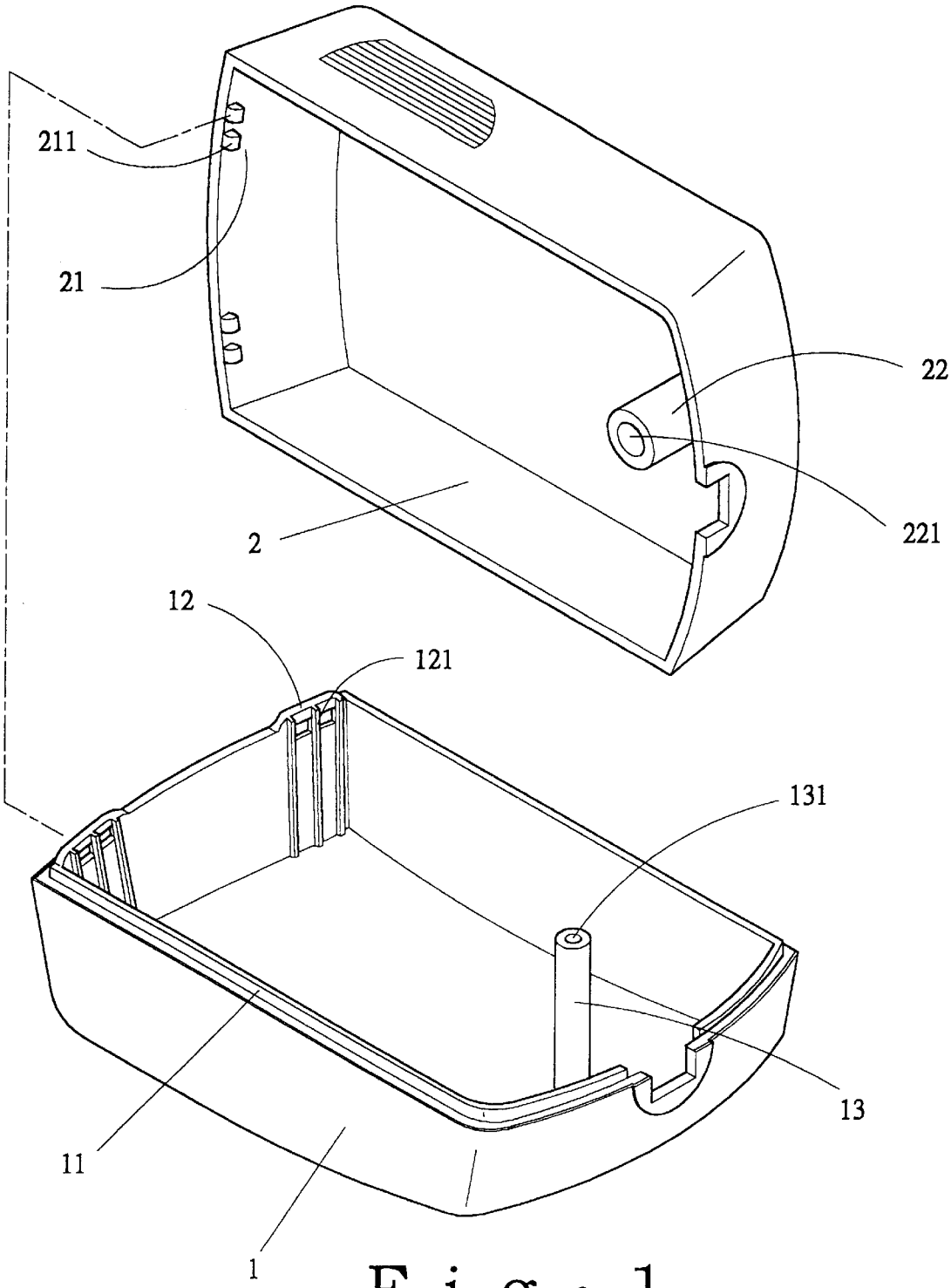
FIG. 1 is an exploded view of the present invention.

FIG. 1 shows an exploded view of the present invention. As shown in FIG. 1, the present invention mainly includes tow half casings 1, 2 whose apertures are provided opposite to each other, wherein a flange 11 is disposed around the aperture rim of the half casing 1, at prearranged position of which a number of engaging seats 12 are provided, at the rear side of which several parallel strengthening ribs 121 are fitted, and wherein at least one locating post 13 upwards extended is provided on the bottom surface of the half casing 1, at the end of which a screw hole 131 is disposed, and wherein the half casing 2 has an engaging projection 21 opposite to the engaging seat 12 of the half casing 1, which contains an arched face 211 adjacent to the opening side of the half casing 2, and wherein the half casing 2 has a connecting seat 22 at the bottom side thereof which is disposed opposite to the locating post 13 of the half casing 1 and contains a fish eye hole 221 therein.

Figure 2:
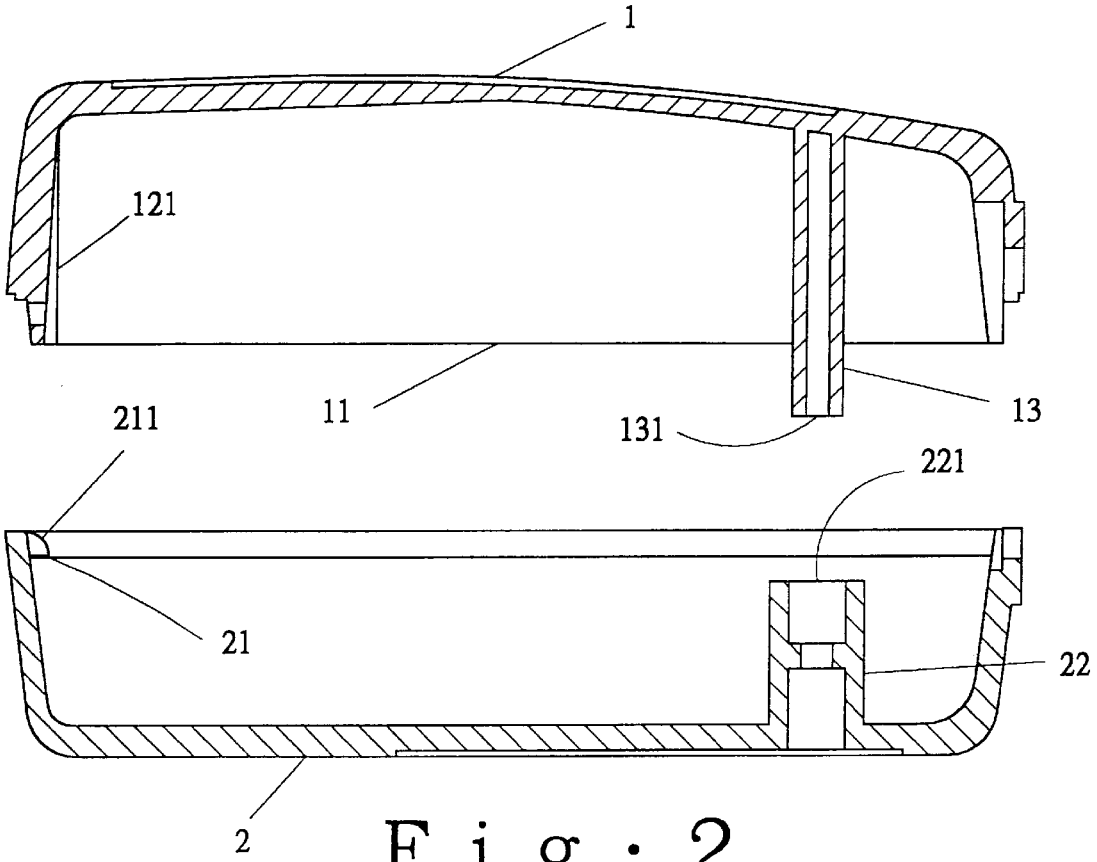
FIG. 2 is a cutaway view of the present invention.
Figure 3:
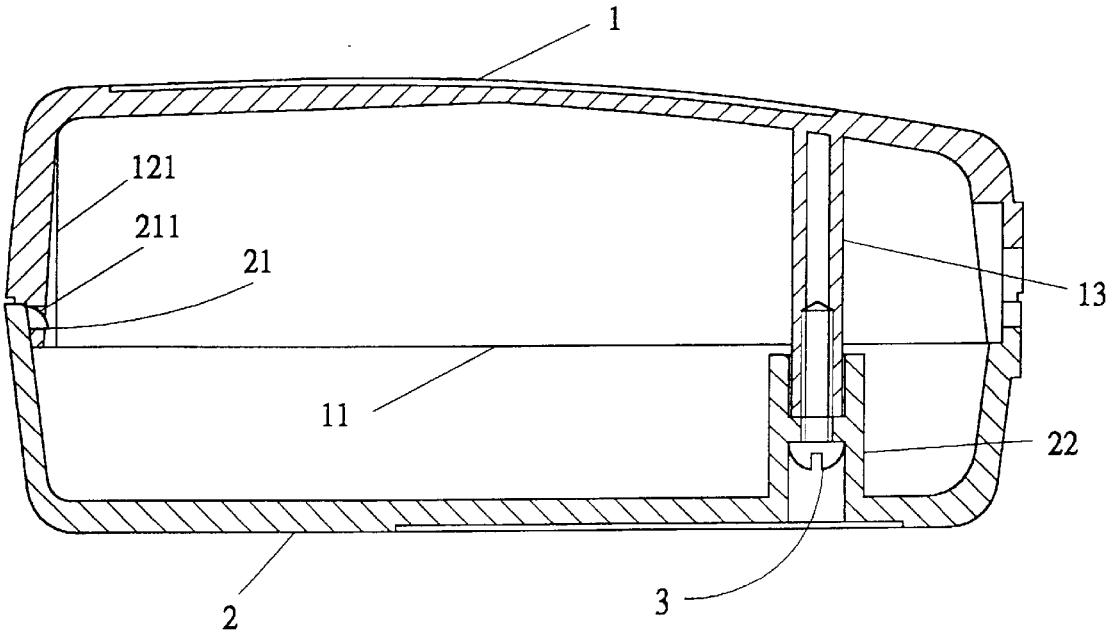
FIG. 3 is a cutaway view of the present invention after assembly.

FIGS. 2 and 3 show cutaway views of the present invention. As shown therein, in assembly, the locating post 13 and the connecting seat 22 of the half casings 1, 2 are connected to each other first; thereafter, the half casings 1, 2 are covered together so that the half casing 2 is connected at the outer side of the flange 11 of the half casing 1. By means of the arched face 211, the engaging projection 21 can be easily locked in the engaging seat 12 to achieve the effect of simple assembly. The strengthening ribs 121 at the rear side of the engaging seat 12 can be used to increase the strength of the engaging seat 12. A screw 3 is placed into the fish eye hole 221 of the connecting seat 22 and tightened into the screw hold 131 at the end of the locating post 13 so that the half casings 1, 2 are secured in a stable state.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A case locking arrangement mainly comprising two half casings whose apertures are provided opposite to each other, wherein a flange is disposed around the aperture rim of said half casing, at prearranged position of which a number of engaging seats are provided, and wherein at least one locating post upwards extended is provided on the bottom surface of said half casing, at the end of which a screw hole is disposed, and wherein said half casing has an engaging projection and a connecting seat corresponding to said engaging seat and said locating post, and wherein the connecting seat contains a fish eye hole therein, characterized in that a number of parallel strengthening ribs are provided at the rear side of said engaging seat in order to strengthen said engaging seat, and that said engaging projection contains an arched face adjacent to the outer side of the aperture of said half casing in order to facilitate the engagement of said engaging projection into said engaging seat, and that a screw can be placed into said fish eye hole of said connecting seat and tightened into said screw hold of said locating post so that said half casings can be easily secured in a stable state.

* * * * *